US006504109B1

(12) United States Patent
Aval et al.

(10) Patent No.: US 6,504,109 B1
(45) Date of Patent: Jan. 7, 2003

(54) MICRO-STRIP CIRCUIT FOR LOSS REDUCTION

(75) Inventors: Omid Aval, Järfälla (SE); Håkan Berg, Göteborg (SE); Spartak Gevorgian, Göteborg (SE); Bertil Hansson, Agnesberg (SE); Harald Jacobsson, Västra Frölunda (SE); Thomas Lewin, Onsala (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/605,636

(22) Filed: Jun. 28, 2000

(30) Foreign Application Priority Data

Jun. 29, 1999 (SE) ..... 9902467

(51) Int. Cl.[7] ..... H01R 9/09

(52) U.S. Cl. ..... 174/261; 174/255

(58) Field of Search ..... 174/36, 268, 261; 361/774, 775, 777, 781, 782

(56) References Cited

U.S. PATENT DOCUMENTS

| | | | | |
|---|---|---|---|---|
| 3,663,739 A | * | 5/1972 | Chevrier | 174/36 |
| 4,045,750 A | * | 8/1977 | Marshall | 174/36 |
| 5,539,241 A | | 7/1996 | Abidi et al. | |
| 5,753,968 A | | 5/1998 | Bahl et al. | |
| 5,834,995 A | | 11/1998 | Richards et al. | |

FOREIGN PATENT DOCUMENTS

| | | |
|---|---|---|
| JP | 2-235406 | 9/1990 |
| JP | 4368005 | 12/1992 |

OTHER PUBLICATIONS

"End–Effect in Quasi–TEM Transmission Lines" by Getsinger, IEEE Transactions on Microwave Theory and Techniques, vol. 41, No. 4, pp. 666–672, Apr. 1963.

"Bulk Micromaching of Silicon" by Kovacs et al., Proceedings of the IEEE, vol. 86 No. 8, pp. 1536–1551, Aug. 1998.

IEEE Electron Device Letters, vol. 14, No. 5, May 1993, J.Y.C. Chang et al., "Large Suspended Inductors on silicon and Their Use in a 2–um CMOS RF Amplifier" pp. 246–248;.

IEEE Journal of Solid–State Circuits, vol. 32, No. 5, May 1997, Jan Craninckx "A 8.1–GHz Low–Phase–Noise CMOS VCO Using Optimized Hollow Spiral Inductors" pp. 736–744.

IEEE Transactions on Microwave Theory and Techniques, vol. 44, No. 1, Jan. 1996, and Joachim N. Burghartz et al., "Microwave Inductors and Capacitors in Standard Multilevel Interconnect Silicon Technology" pp. 100–104.

* cited by examiner

*Primary Examiner*—Kamand Cuneo

(57) ABSTRACT

A printed circuit (1) on a lossy substrate (2) has been provided whereby intermediate structures (11, 12, 17, 18) under the top layer strips (5) have been formed having a width being ($d_2$) smaller than the width (w) of the strip. The intermediate structures (11, 12, 17, 18) are particular well suited for inductors (9) on silicon substrates and result in a considerable increase in the Q-factor of the inductor at microwave frequencies.

7 Claims, 7 Drawing Sheets

MICRO-STRIP CIRCUIT FOR LOSS REDUCTION

FIELD OF THE INVENTION

The present invention concerns printed circuits formed by standard technologies and concerns the reduction of losses appearing in these circuits.

More specifically, the invention concerns micro-strip inductors for Microwave Monolithic Integrated Circuits (MMIC) based on silicon substrates or other lossy substrates.

BACKGROUND OF THE INVENTION

Inductor coils constitute an important group of components for MMIC's and inductor quality is often a limiting factor for the performance of such MMIC circuits that typically operate in the frequency band of up to 10 GHz.

Inductors for these applications may be characterised by the quality factor, Q, which can be defined as:

$$Q=\omega L/r;$$

where ω is the circular frequency, L is the inductance and r is the parasitic resistance.

The Q-factor is normally limited by three types of losses, namely by losses in the substrate, losses in the metal strips and by the losses relating to the radiation of electromagnetic energy from the circuit. However, the radiation losses are normally negligible in comparison with the other two types of losses.

Substrate losses are normally dominant where the resistivity of silicon is smaller than 1–10 Ω·cm. For substrate resistivities above 100 Ω·cm the losses in the metal strips become dominant.

Many proposals have been put forward in the prior art for reducing losses in inductors on silicon based substrates. One way of doing this is to reduce the substrate losses.

Substrate Losses

In prior art document "Large suspended Inductors on Silicon and their Use in a 2 μm CMOS RF Amplifier", by Chang et al., IEEE Electron Device Letters, Vol. 14, No. 5, May 1993, pp. 246, a suspended inductor has been proposed. The inductor comprises segments of strips, for which the underlying substrate has been removed thereby leaving the section freely suspended in the air. Accordingly, substrate currents in the immediate vicinity of the section of the strips are avoided. According to this document, the suspension may be achieved by selectively etching out the silicon, leaving the inductor encased in a suspended oxide layer attached at four corners to the rest of the silicon IC.

In U.S. Pat. No. 5,539,241, a suspended inductor is shown having a similar structure to the suspended inductor mentioned above. According to this document a membrane dielectric layer is formed on the silicon substrate for preventing an anisotropic backside etch during removal of the substrate underneath the inductor.

Strip Losses

A reduction of strip losses has also been suggested in the prior art.

According to prior art document "Microwave Inductors and Capacitors in Standard Multilevel Interconnect Silicon Technology", Burghartz et al, IEEE Transactions on Microwave Theory and Techniques, Vol.44, No. 1, January 1996, pp. 100–104, a multi-layer inductor has been suggested, which reduces the above losses. The multi-layer inductor disclosed in this document comprises conductive via array shunts arranged between the layers forming the coil of the inductor for enhancing the current carrying cross-section of the inductor. Thereby, the current density and hence the effective ohmic resistance of the inductor coil has been lowered.

One important factor, which might reduce the effective current carrying area of the strips, is the so-called current crowding effect according to which the current in a strip is non-uniformly distributed due to the generation of eddy currents in the strips.

The implication of the current crowding effect on inductors has for instance been mentioned in prior art document "A 1.8 GHz Low-Phase-Noise CMOS VCO Using Optimised Hollow Spiral Inductors" by Craninckx et al. IEEE Journ. Solid State Circuits, Vol.32, No.5, 1997, pp. 736–744. In this document, it is found that especially the inner turns of the coils are affected by losses due to eddy currents causing a non-uniform current distribution. As a general recommendation, it has been proposed that spiral coils should have narrow strips and a free inner area of the coil.

Radiation Losses

As will be readily understood, the Q-factor of an inductive coil depends not only on the ohmic losses, but also on the inductance and hence on the geometry of the coil.

For instance, it is known that 90° bends (c.f. "End-Effects in Quasi-TEM Transmission lines" by Getsinger, IEEE Trans. Microwave Theory Techn. Vol. 41, pp. 666–672, 1993) in the strips act like "open circuits" for the currents whereby negative inductances are introduced due to the stray magnetic fields. This phenomenon leads to a substantial reduction of the total inductance and of the Q-factor of the coil.

In FIG. 3 the Q-factor relating to two strips, a) being straight and b) comprising a 90° bend, has been indicated as a function of the frequency. The illustration is based on experiments carried out by the inventors. The experiments were based on strips having a mean length of 300 μm, a strip width of 30 μm and strip thickness of 1.5 μm, whereby the substrate was 300 μm thick Si (20 Ωm). The above illustration does not form part of the prior art.

SUMMARY OF THE INVENTION

In the following, the current crowding effect shall be dealt with briefly.

FIG. 1 shows the outline of a conventional coil and FIG. 2, which was produced by the inventors, shows a cross section of the coil shown in FIG. 1 and a schematic illustration of the current distribution in a cross-section of the strip of the coil shown in FIG. 1. It appears that the current density is highest at the edges of the strip and that the current density is highest in the inner turns of the coil.

FIGS. 4 and 5, which were produced by the inventors, relates to a computer-simulated analysis (Momemtum® by Hewlett Packard® of a circuit being modelled with the strips being formed directly on a lossy substrate. FIG. 4 is a schematic illustration of the current distribution on a straight strip and shows—in compliance with FIG. 2—that current crowding is effected at the edges of the strip, whereby the current density is higher (indicated by h) than at the central portion of the strip.

FIG. 5 is a schematic illustration of the current distribution for a strip having a 90° bend and demonstrates that the current density at the edges of the strips and especially at the internal edge of a 90° bend, is higher than at the central portions of the strip.

FIG. 6*a* which shows more accurately the variation in the current density according to the lateral position of the strip along line A—A in FIG. 4 for a typical configuration. It is seen that the current density is highest at the edges and lowest at central portions of the strip. FIG. 6*b* is similar to FIG. 6*a* but relates to FIG. 5 along line B—B. The current density is highest at the internal bend.

It should be noted that the current density would depend on many factors such as dielectric properties of the substrate, the thickness of the substrate, the strip width, the frequency applied etc. Moreover, it should be noted that the current density varies along the edges of the strip shown in FIG. 5 as well as on the central portions. However, the general pattern is as shown in FIGS. 4, 5, 6*a* and 6*b*. More accurate results for a given strip configuration can be found using for instance simulation tools as indicated above.

The current crowding effect increases the ohmic losses and reduces the Q-value of the inductive properties of the strip.

One object of the present invention is to accomplish a new and more effective design for standard micro-strip circuits based on lossy substrates.

This object has been achieved by subject matter whereby a intermediate member having a low dielectric constant or being conductive is formed under the strip, the intermediate member having a minimum lateral extension being less that the width of the strip.

The disclosed micro-strip circuit leads to a reduction in locally appearing areas of high current densities as compared to the prior art structures mentioned above. The intermediate member forces currents to the parts of the strips being located over the intermediate member, thereby rendering the cross-sectional distribution of the current in the strips more uniform. Consequently, the effective current carrying area of the strip increases such that a reduction of the strip losses is accomplished.

The invention may be applied for single layer technology, whereby the circuit is being printed directly on a lossy substrate. This solution is further advantageous in that the substrate losses are reduced.

The invention may also be applied in multi-layer technology, whereby a first circuit layer is provided on a lossy substrate and more layers are provided on top of these, each layer being separated by respective dielectric layers.

It is a further object to achieve further reductions in losses, especially substrate losses appearing at the bends of the strips.

The micro-strip circuits according to the invention can be produced very economically, both in large and small-scale production.

Further advantageous features will appear from the remaining dependent claims and the following detailed description.

DESCRIPTION OF A FIRST PREFERRED EMBODIMENT OF THE INVENTION

Figure 7:
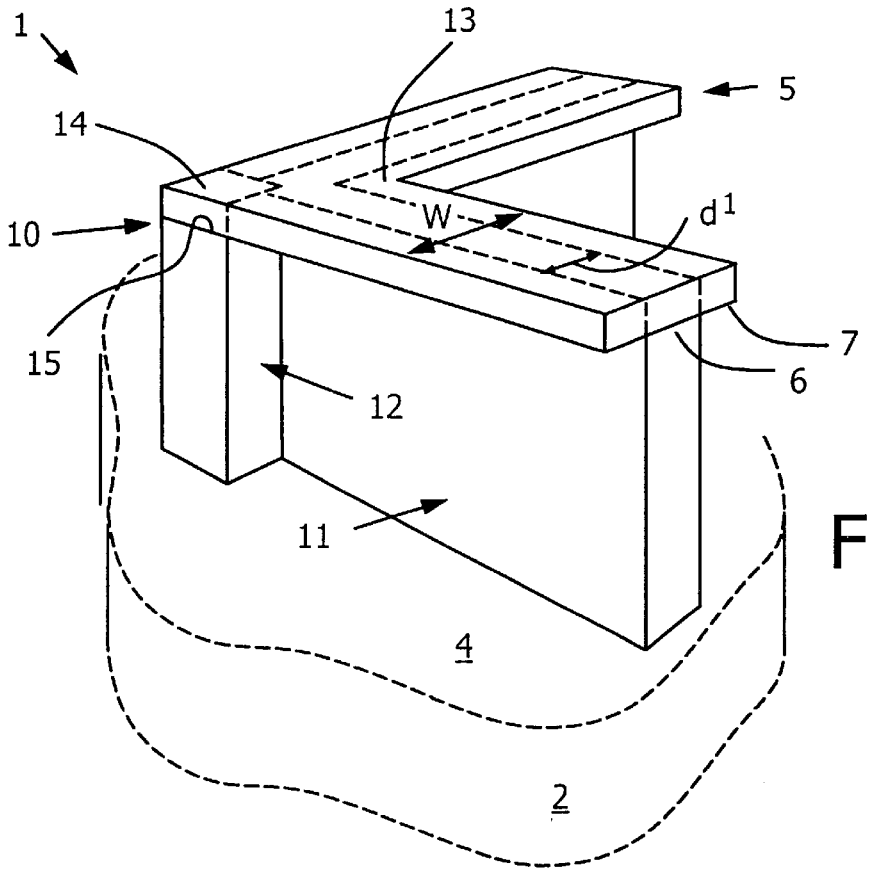
FIG. 7 is a perspective view of an intermediate member according to a first embodiment of the invention.

In FIG. 7, a first preferred embodiment of the invention has been shown, namely a detail relating to a corner portion 10 of a printed circuit 1 comprising a substrate 2 and strips 5. The corner portion 10 of the circuit 1 comprises a substrate floor 4, a first intermediate member 11 shaped like a wall supporting a straight portion of the micro-strip and a second intermediate member 12 shaped like a column supporting the corner portion 10 of the strip 5.

Figure 1:
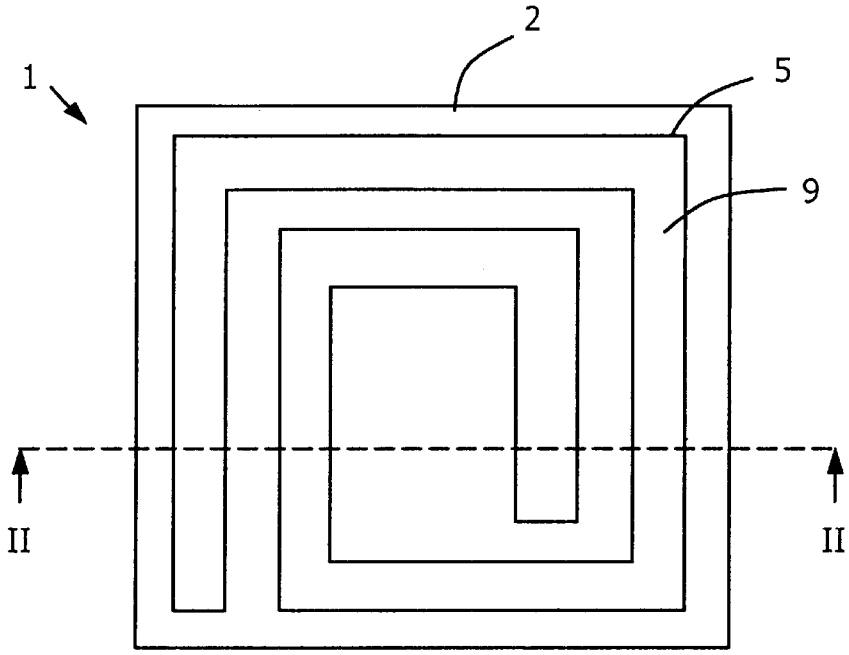
FIG. 1 PRIOR ART
FIG. 1 shows a known simple coil structure being provided as a micro-strip circuit on a substrate.

The corner portion could for instance relate to the inductor shown in FIG. 1.

The first wall shaped intermediate member 11 has a width, $d_1$, that is narrower than the width of the strip, w.

Moreover, the first intermediate member 11 is arranged centrally under the strip 5 at straight sections such that non-supported portions 7 of the strip 5 is extending over both sides of the first wall shaped intermediate member 11.

The intermediate member 11 has a high relative permittivity, while the medium, which surrounds the intermediate member laterally, has a low relative permittivity. Preferably, both the intermediate member and the medium have low ohmic losses. The surrounding medium could be constituted by a gas, a fluid, vacuum, or some sort of material.

The high relative permittivity of the intermediate member 11 creates a dipole effect among the molecules in the material, which lowers the voltage drop through the intermediate member. Thereby an e-field is created at the external edges of the top layer strip, having a lateral component, pointing in the direction of the intermediate member.

This results in a redistribution of charges and currents from the edges of the strip to the central portion of the strip.

According to the invention, the intermediate member is preferably arranged where the current distribution would have its minimum, if the intermediate member was not provided. Thereby, the current crowding effect is reduced.

In accordance with the figures relating to the computer analysis for the current distribution for a straight strip and a 90° bend, as indicated in FIGS. 4, 5, 6*a* and 6*b*, the intermediate member is arranged aligned about the centre line of the top layer strip. In bend portions of the upper layer strip the intermediate member is arranged at the outside.

Although only a corner portion 10 of the circuit 1 has been shown, it should be understood that the first intermediate member 11, being formed like a wall, could extend under the strip along the full length or along any desired length of the strip 5.

In the embodiment shown in FIG. 7, the second intermediate member 12 is formed in conjunction with the first intermediate member 11.

The second intermediate member 12 is advantageously arranged at the external edge 14 of the corner portion 10 for forcing currents away from the internal bend of the corner 13, in order to avoid the current crowding in this area, and thus render the current distribution more even in the corner area 10.

Moreover, the second intermediate member 12 constitutes a fortification of the support of the outer edge of the corner portion of the strip 5, enhancing the mechanical stability of the structure.

As shall be explained more in detail in the following, the strip circuit 1 can be manufactured by providing a strip pattern on a substrate whereupon the portions of the upper surface of the substrate are selectively removed by etching leaving a recess forming the substrate surface 4 and intermediate members 11 and 12 as shown in FIG. 7. In this way, both intermediate members 11 and 12 have an upper face 15 which is in alignment with the upper surface 3 of the remaining substrate 2 and on which the strips 5 are mounted.

It should also be understood that the strip circuit 1 could constitute for instance a square spiral formed inductor 9 of similar layout to the inductor shown in FIG. 1. In this case, there is provided first intermediate members 11 along all straight strips 5 and second intermediate members 12 in each corner 10 of the inductor 9.

However, the second intermediate member 12 according to the invention need not necessarily be provided in all cases. Inductors having only round windings should preferably be provided with the first type of intermediate member 11 only. Likewise, circuits comprising no sharp corners may be provided with only first wall like intermediate members 11.

It would be possible to use the first type of wall shaped intermediate member 11 under a corner portion of a square shaped spiral inductor 9, although such an embodiment would not provide as good results as the embodiment shown in FIG. 7.

It is also envisaged that the first and second intermediate members 11 and 12 could have rounded edges. For instance, the edge formed between first intermediate member 11 and second intermediate member 12 could be replaced by a curved section.

Second Preferred Embodiment of the Invention

Figure 8:
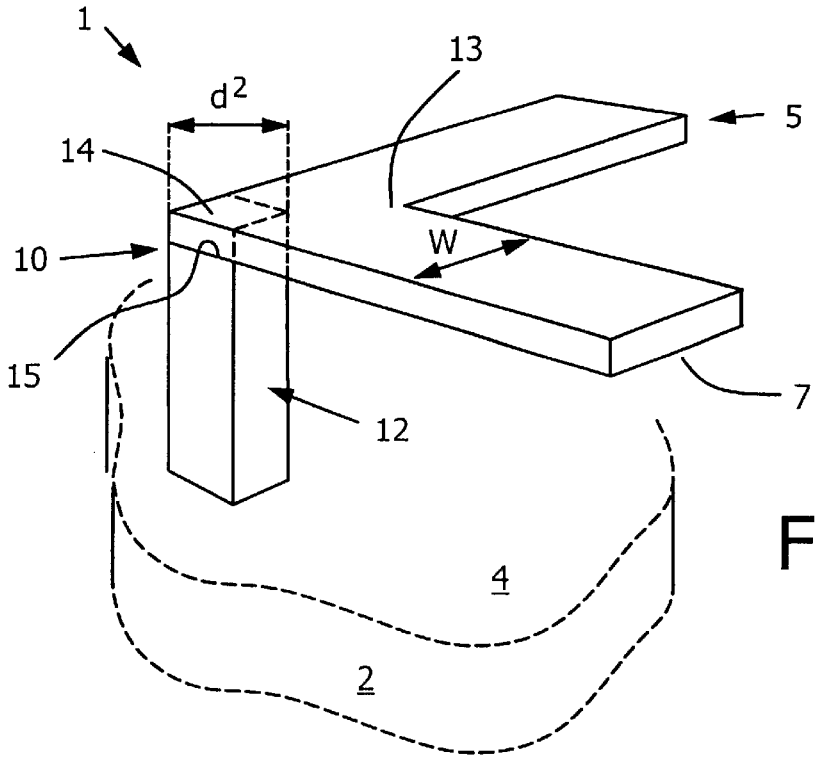
FIG. 8 is a perspective view of a intermediate member of a second embodiment of the invention.

According to another embodiment of the invention, which has been depicted in FIG. 8, only a second columnar intermediate member 12 has been provided under the corner portion 10 of the strip 5, whereby the top surface 3 of the corner portion supporting the strip 5 has a maximum lateral extension, $d_2$, which is smaller than the strip width, w. Again, the corner portion could for instance relate to the inductor structure shown in FIG. 1.

This embodiment is advantageous for high loss substrates, because of the reduced amount of support contacting the strip 5.

Also, in the embodiments according to FIG. 8, the currents from the internal bend 13 of the corner 10 are forced to the external bend 14 of the corner, rendering the current distribution more uniform. This will decrease the resistance associated with the corner portion 10 and will result in larger inductances.

Third Preferred Embodiment of the Invention

Figure 9:
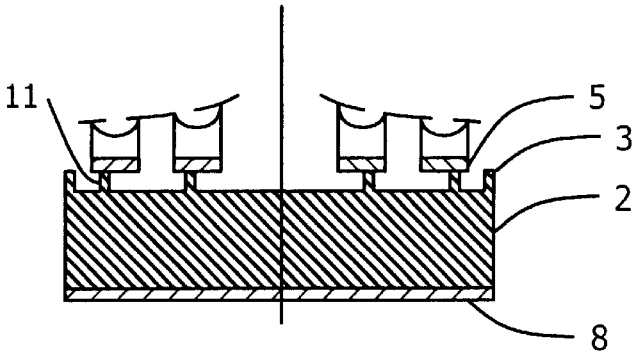
FIG. 9 is similar to FIG. 2, but relates to the cross-section of an inductor, having an intermediate member according to a third embodiment of the invention.
Figure 3:
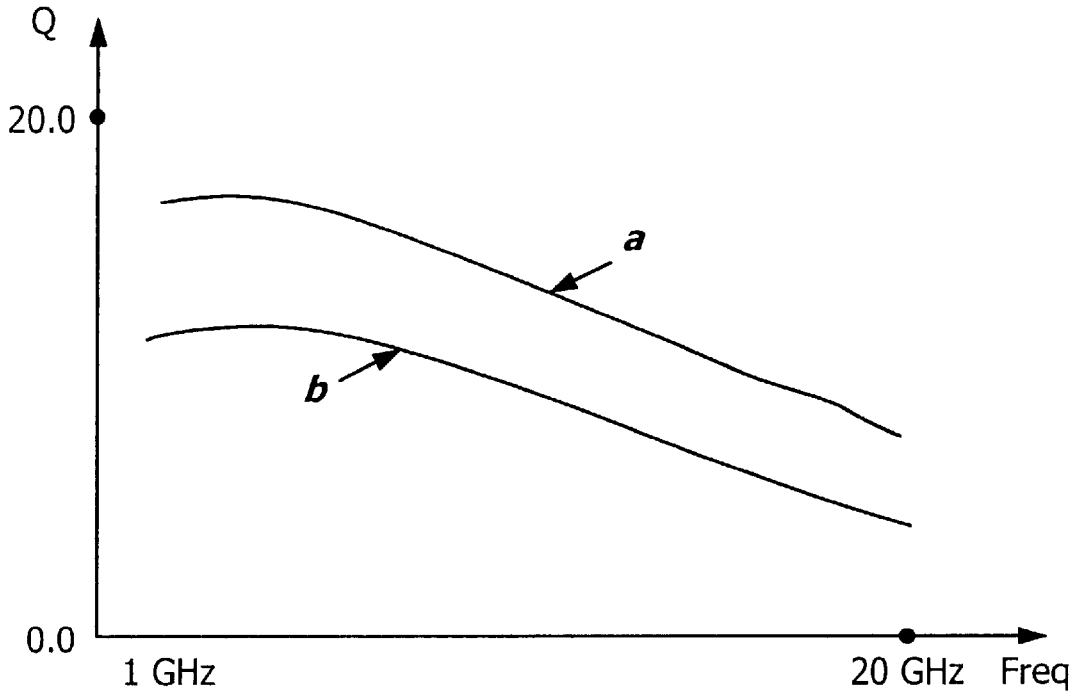
FIG. 3 PRIOR ART
FIG. 3 shows the relation between the quality factor Q and the frequency for respectively a straight strip and a strip having a 90° bend.

FIG. 9 shows another embodiment of the invention, relating to the known inductor layout shown in FIG. 1. This embodiment incorporates advantageously also second intermediate members 12 in the corners of inductor in analogy with FIG. 7. Here again, a portion of the substrate is removed such that vertical wall-shaped intermediate members 11 are formed under the strips 5, but in this case, the intermediate members have been placed asymmetrically. The intermediate members 11 force the currents to the parts of the strips 5 contacting the intermediate members 11 due to the high relative permittivity, making the cross-sectional distribution of the current densities in the strips more uniform. Consequently, the effective current-carrying area of the strip will increase and the resulting ohmic losses will be reduced.

Figure 2:
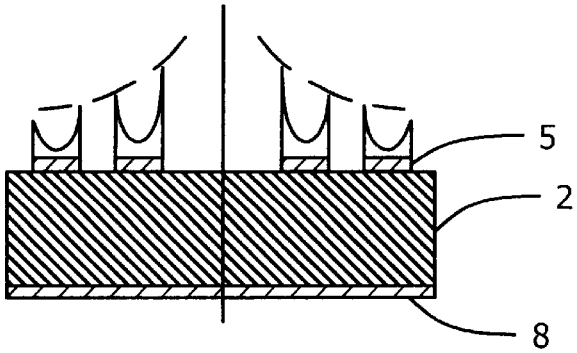
FIG. 2 PRIOR ART
FIG. 2 represents a cross-section along line A—A of FIG. 1, whereby the current distribution in the ps have been indicated.

In the upper part of FIG. 9, the current density corresponding to the position in the strip has been indicated. It appears that the current densities in the edges are smaller than the current densities indicated in FIG. 2 for corresponding locations in the coil. In other words, the currents are more uniformly distributed across the strips.

Figure 4:
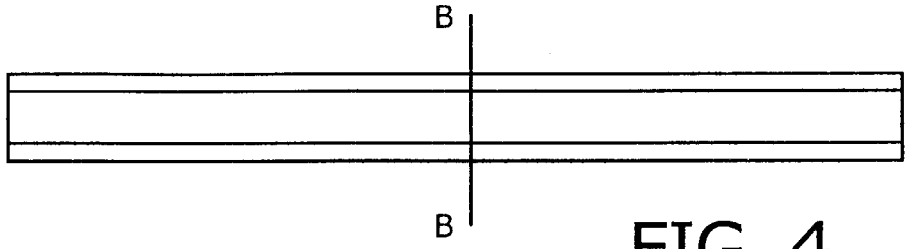
FIG. 4 PRIOR ART
FIG. 4 is a coarse graphical representation of the current density in a straight strip being provided on a lossy substrate.
Figure 5:
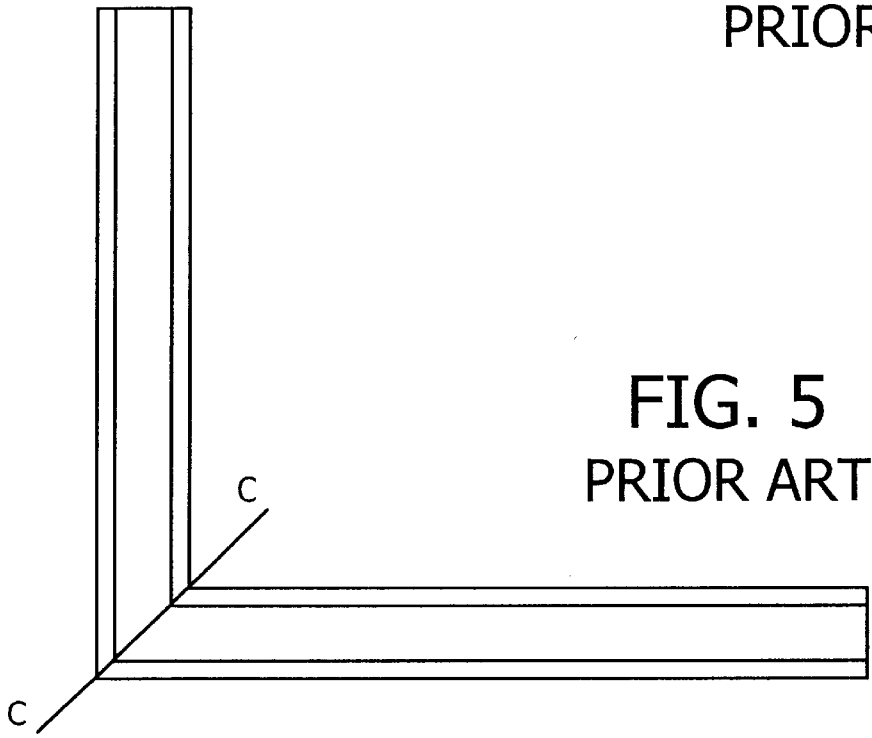
FIG. 5 PRIOR ART
FIG. 5 is a coarse graphical presentation of the current density in a strip comprising a 90° bend being provided on a lossy substrate.

In the FIG. 9 embodiment the intermediate members are placed at a position under the strips, where—if substrate was not removed—the minimum current density would appear. This location—or line, if the whole length of the strip is taken into account—can be found for a given circuit by using a standard circuit analysis, such as the computer simulation analysis on which FIG. 4 and FIG. 5 are based.

In contrast with the known suspended coil design, where the coil is supported by a thin dielectric membrane, the proposed designs are mechanically more stable.

Furthermore, for high resistivity substrates ($p>100\ \Omega m$) D.C. voltages applied to the strips of the coil results in changes in the surface depleted (accumulated or inverted) layers of silicon making the coil parameters dependent on the applied voltage. In the proposed design, this effect will be substantially reduced or in the case of extremely high resistivity, substrates may be almost completely eliminated if the thickness of the silicon walls under the strips is comparable with the depletion depth. For such thickness, the intermediate members will be completely depleted and the changes in the strip voltages will not affect the performance of the inductors.

It appears that there exists is an optimum lateral thickness for the intermediate members under the strips where the current distribution is most uniform and the losses in the strips are minimal. Practical experiments show that the optimal width of the intermediate member lays in the interval of $3\delta<d_1<(w-2\delta)$ for the first wall shaped type of intermediate member, whereby $d_1$ denotes the width of the intermediate member, w denotes the strip width and $\delta$ denotes the skin depth of the substrate. The second columnar intermediate member may be dimensioned by the same relation, whereby the width of the respective sides of the second columnar intermediate member should be dimensioned with the respective corresponding strip-width.

One possible way of producing the above circuit is accomplished by the following manufacturing steps:

First, the circuit strips are fabricated on a substrate by a standard process. e.g. photolithography. The circuit-strips are for instance of gold while the substrate is silicon.

Subsequently one or more a protection layers are formed on top of the strips 5 by a standard process, for instance by a photolithographic process.

A reactive ion etching process or an equivalent process is then applied, etching vertical trenches in the substrate 2.

After this step, a selective chemical etching, such as an isotropic or misotropic process, is applied for selectively etching substrate in a horizontal direction, whereby substrate 2 material under the strips 5 is removed.

Finally, the at least one protection layer is removed by etching.

Micromachining technology that is known in the art is also an option. Reference is for instance made to "Bulk Micromachining of Silicon" by Kovacs et al., Proceedings of the IEEE, Vol. 86, No. 8 August 1998.

Fourth Embodiment of the Invention

In standard silicon technology usually there are more than two metal layers separated from the silicon substrate and from each other by respective dielectric layers. A further aspect of the invention is applicable to such multi-layer substrate circuits.

Figure 10:
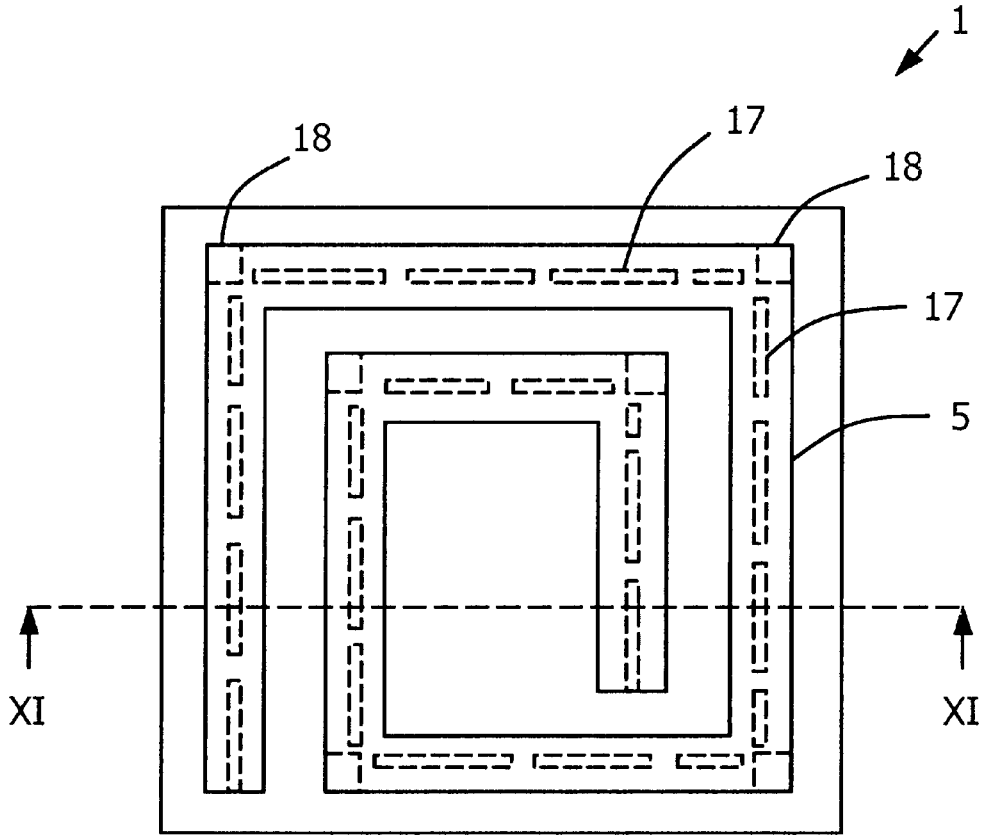
FIG. 10 is a top view of a fourth embodiment of the invention relating to a multi-layer micro-strip structure having intermediate members embedded in a dielectric layer.
Figure 11:
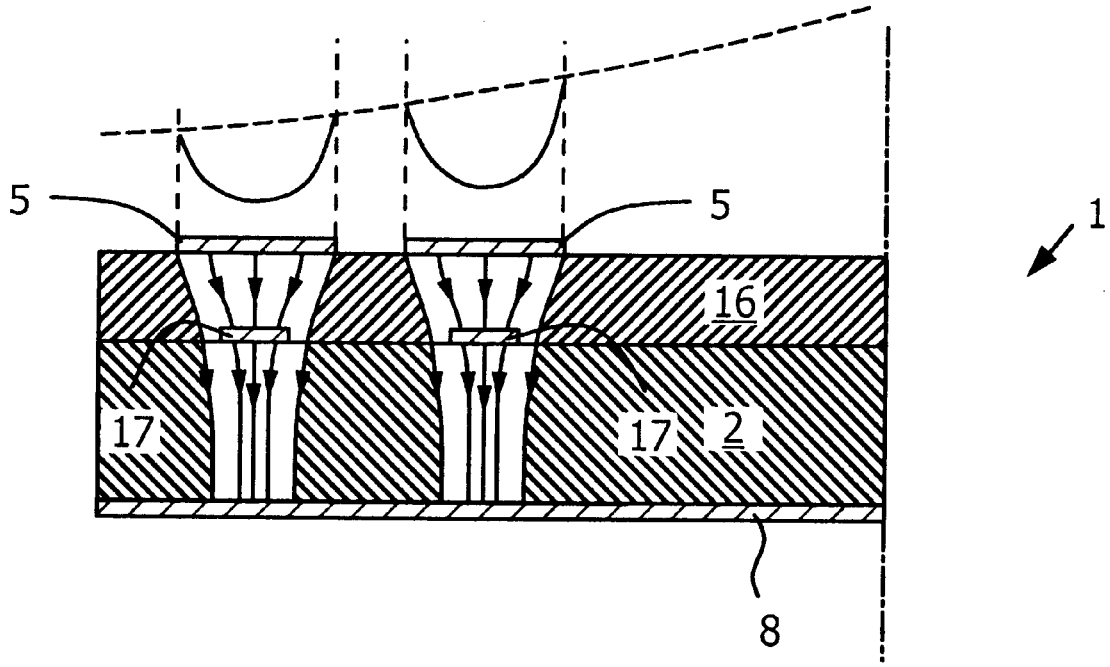
FIG. 11 is a cross-sectional view along line XI—XI in FIG. 10.

The embodiment shown in FIGS. 10 and 11 comprises at a lossy substrate 2, such as silicon substrate, a dielectric layer 16, an intermediate conductive layer forming a strip network interposed between the lossy substrate 2 and the dielectric 16 layer and a top layer forming another strip network 5.

According to FIGS. 10 and 11, the intermediate layer is forming segmented intermediate members 17, 18 under the individual top layer strips 5.

A respective intermediate strip 18 has a width being smaller than the width of the top layer strip 5 at straight sections and is arranged centrally under the associated top layer strip.

When a charge is applied to the top strip, a dipole effect of the molecules will take place in the intermediate member 17, 18. A charge in the top strip 5 will create an opposite charge at the top surface of the intermediate strip 17, 18 and a charge of like polarity to the top strip charge will appear at the underside of the intermediate strip 17, 18. Charges of an opposite polarity will appear at the ground plane. Corresponding E-fields will extend between the top strip and the intermediate strip as well as between the intermediate strip and the ground plane. Moreover, field lines extend directly between the top strip and the ground plane at the external edges of the top strip.

The voltage over the conductive intermediate member 17, 18 would be close to zero. Hence, the effect of the conductive intermediate member 17, 18 can be compared to a local reduction of the distance between the top layer strip and the ground plane 8, which is equivalent to the effect of the members 11 and 12 in FIGS. 7, 8 and 9.

The intermediate member 17, 18 effects that the electrical field between the top layer strip 5 and the ground plane 8 is transformed in such a way that the field at external edges of the top layer strip 5 has a lateral component which points against the centre of the intermediate member 17, 18.

The charge on the external edges of the top strip 5 will be attracted towards the charge of opposite polarity, which is generated on the upper surface of the intermediate strip 17, 18, i.e. charges will be concentrated laterally inwards toward the centre of the upper strip 5 like in the above mentioned embodiments.

According to the invention, the intermediate member 17, 18 is arranged at a location where a charge density minimum in the top layer strip 5 would appear, if the intermediate member was not provided. Furthermore, the intermediate member should have a lateral extension, which accomplishes that the E-field is "pinched" in the middle as shown in FIGS. 10 and 11.

The current crowding effect will be superposed on the above mentioned charge concentration.

By suitable dimensioning of the intermediate member 17, 18, the effects of current crowding and charge concentration will balance out one another such that a homogenous charge distribution can be accomplished on the top strip. Accordingly, a reduction of the ohmic losses in the top strip can be accomplished.

Figure 6A:
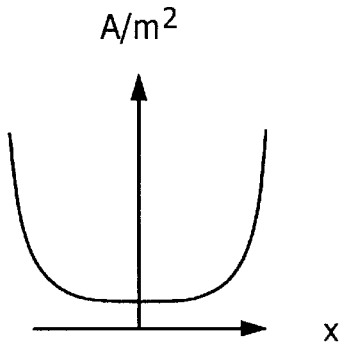
FIG. 6a PRIOR ART
FIG. 6*a* is a graph indicating the current density along the line B—B in FIG. 4.
Figure 6B:
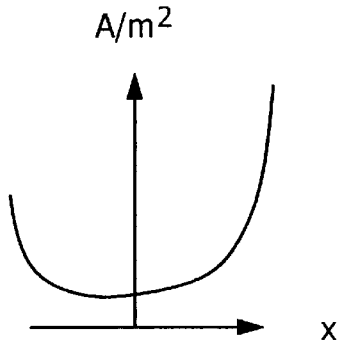
FIG. 6b PRIOR ART
FIG. 6*b* is a graph indicating the current density along the line C—C in FIG. 5.

In compliance with the results which was found in connection with FIGS. 6*a* and 6*b*, the conductive intermediate member 17 is centrally arranged under straight portions of the top layer strips 5. In the bends of the top layer strips 5, the intermediate member 18 is arranged under the outer edge of the top layer strip.

For typical applications, good results are achieved where the width of the intermediate strip is equal or less than a third of the width of the top strip.

Preferably, the intermediate strip is divided into segments for preventing standing waves from occurring, but a non-broken intermediate member could also be used. Likewise, the intermediate member could be electrically coupled to the top strip at given locations. This segmentation may be applied to all embodiments of the invention.

Figure 12:
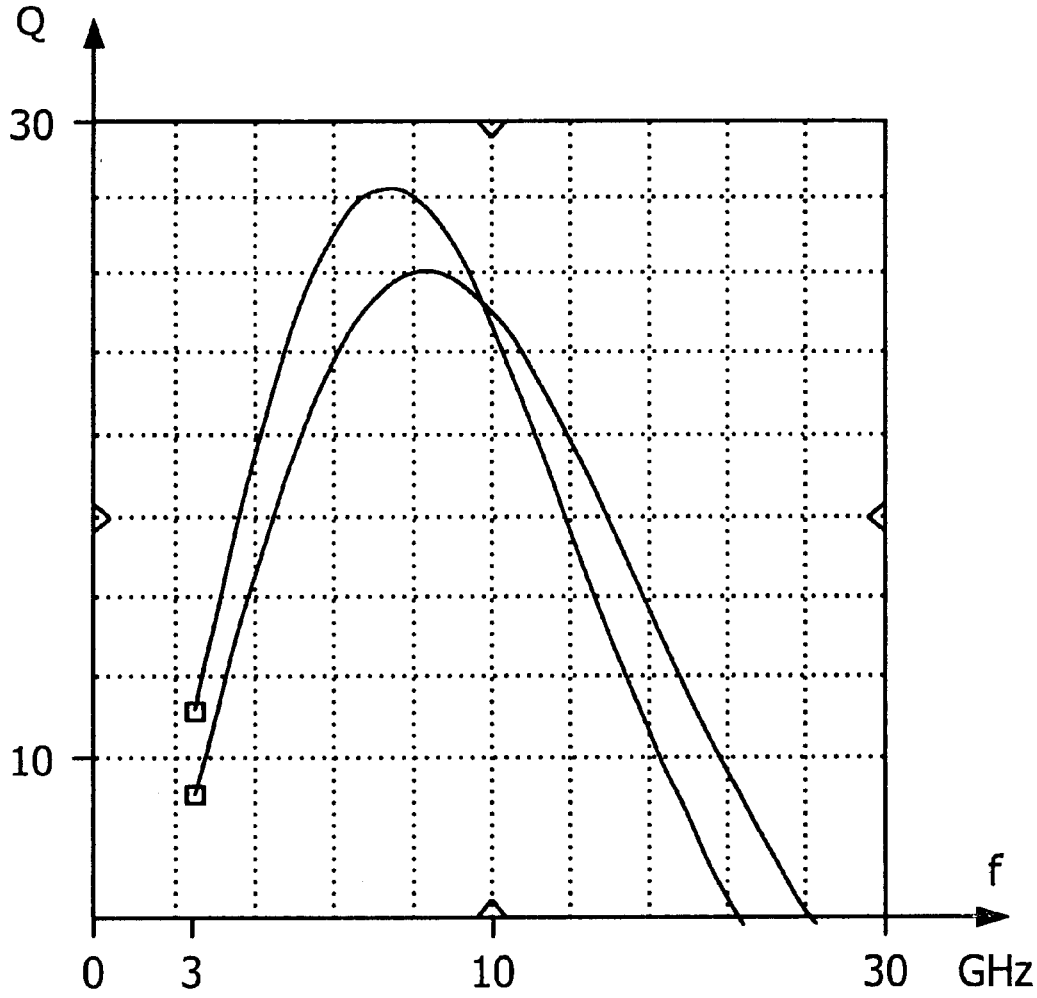
FIG. 12 shows a set of graphs of the Q-factor versus frequency relating respectively to a coil structure with intermediate members according to the fourth embodiment of the invention and a similiar structure without such intermediate members.

In FIG. 12, the effect of the intermediate members for a coil structure shown in FIGS. 10 and 11 in comparison to a similar coil structure lacking intermediate members has been shown.

It is seen that the Q-factor of the coil with the intermediate members is higher than the similar coil without the intermediate members for frequencies below 10 GHz.

In conclusion, a Q-factor enhancement is provided for a coil structure using standard low cost manufacturing techniques.

| Reference numbers | |
|---|---|
| 1 | micro-strip circuit |
| 2 | substrate |
| 3 | upper surface of substrate |
| 4 | floor of substrate |
| 5 | top layer strip |
| 6 | supported part of strip |
| 7 | non-supported part of strip |
| 8 | ground plane |
| 9 | square-shaped spiral inductor |
| 10 | corner portion |
| 11 | wall-shaped intermediate member |
| 12 | column shaped intermediate member |
| 13 | internal bend of corner |
| 14 | external bend of corner |
| 15 | top face of intermediate member |
| 16 | dielectric layer |
| 17 | segmented conductive intermediate member |
| 18 | corner portion of conductive intermediate member |

What is claimed is:

1. Micro-strip circuit (1) comprising a dielectric substrate (2, 16) having a top layer of conductive strips (5) being provided over or on top of the dielectric substrate and a ground plate (8) being provided under the lossy substrate, the micro-strip circuit comprising an intermediate member (17, 18) being formed under at least some of the strips (5) forming the top layer circuit, the intermediate member having a width being less than the width of the top layer strip and extending along at least sections of the circuit formed by the top layer strips (5), the intermediate member (17, 18) being surrounded laterally by a dielectric medium or material, wherein the dielectric substrate is a lossy material and comprises at least two layers (2, 16), the intermediate member being formed of a conductive material and being arranged between the at least two layers of dielectric substrate, whereby dielectric substrate surrounds the intermediate member (17, 18) laterally.

2. Micro-strip circuit according to claim 1, whereby the intermediate member (17) is arranged centrally under the strips (5) at straight section of the top layer strips.

3. Micro-strip circuit according to claim 1, wherein intermediate member (18) is displaced from the centre at bends of the top layer strips towards the external edge of the bend.

4. Micro-strip circuit according to claim 1, whereby intermediate member (17, 18) is printed on a substrate layer (2).

5. Micro-strip circuit (1) comprising a substrate (2) having a top layer of conductive strips (5) being provided over or on top of the lossy substrate and a ground plate (8) being provided under the lossy substrate, the micro-strip circuit comprising an intermediate member (11, 12) being formed under at least some of the strips (5) forming the top layer circuit, the intermediate member having a width being less than the width of the top layer strip and extending along at least sections of the circuit formed by the top layer strips (5), the intermediate member (11, 12) being surrounded laterally by a dielectric medium or material, the intermediate member (11, 12) having a high relative permittivity in relation to the surrounding medium or material, whereby the intermediate member forms part of the lossy substrate (2) or is being formed by a separate layer of a lossy material, the medium surrounding the intermediate member having a low relative permittivity characterised in that the intermediate member (12) is displaced from the centre at bends of the top layer strips towards the external edge of the bend.

6. Printed circuit according to claim 5, whereby the micro-strip circuit has been manufactured by:

providing a pattern of conductive strips (5) on an upper surface (3) of a substrate (2);

removing substrate (2) vertically by reactive ion etching;

removing substrate (2) horizontally by chemical selective under-etching.

7. Micro-strip circuit according to claim 1, wherein the intermediate member (11, 12, 17, 18) comprises a plurality of interruptions, forming a plurality of segments.

* * * * *